United States Patent [19]

Latina et al.

[11] 4,135,252

[45] Jan. 23, 1979

[54] SHOULDER PAD

[75] Inventors: Roland N. Latina, Belleville, Ill.; Hal D. Mitchell, Rolla, Mo.

[73] Assignee: A-T-O Inc., Willoughby, Ohio

[21] Appl. No.: 804,013

[22] Filed: Jun. 6, 1977

[51] Int. Cl.[2] ..... A41D 13/00

[52] U.S. Cl. ..... 2/2; 2/268

[58] Field of Search ..... 2/2, 267, 268

[56] References Cited

U.S. PATENT DOCUMENTS

| | | | |
|---|---|---|---|
| Re. 22,084 | 4/1942 | Lookabaugh | 2/2 |
| 1,862,441 | 6/1932 | Till | 2/2 |
| 1,862,442 | 6/1932 | Till | 2/2 |
| 2,251,018 | 7/1941 | Lookabaugh | 2/2 |
| 3,127,614 | 4/1964 | Bennett | 2/2 |
| 3,134,106 | 5/1964 | Shaffer et al. | 2/2 |
| 3,158,871 | 12/1964 | Morgan | 2/2 |
| 3,528,106 | 9/1970 | Austin | 2/2 |

*Primary Examiner*—Werner H. Schroeder

*Assistant Examiner*—Moshe I. Cohen

*Attorney, Agent, or Firm*—Koenig, Senniger, Powers and Leavitt

[57] ABSTRACT

A shoulder pad for football players comprising a chestplate portion, a backplate portion and a pair of arches integrally connecting the plate portions, the arches being laterally spaced to provide an opening for the neck of the wearer with the spacing such that the arches lie adjacent and relatively close to the neck. The arches and padding thereunder are relatively narrow in relation to the width of the shoulders so as to provide freedom for upward movement of the outer part of the shoulders without substantial interference from the arches. A pair of caps of relatively rigid material adapted to fit over the outer portion of the shoulders are flexibly connected to respective arches and have shoulder padding on the inside thereof separate from the arch padding for enabling the caps and the shoulder padding to move freely upwardly upon upward movement of the outer part of the shoulders.

5 Claims, 5 Drawing Figures

SHOULDER PAD

BACKGROUND OF THE INVENTION

This invention relates generally to athletic apparel, and more particularly to a shoulder pad for football players which allows greater flexibility of movement.

Shoulder pads as conventionally designed have been extremely bulky and cumbersome and have limited the upper body movement of football players to a great degree, having especially impeded movement of the arms above the horizontal position. This has proven to be particularly burdensome on quarterbacks throwing passes and pass receivers. Reference may be made to U.S. Pat. Nos. 1,862,441, 1,862,442, 2,251,018 and 2,741,767, showing prior shoulder pads on which the present invention is an improvement.

SUMMARY OF THE INVENTION

Among the several objects of this invention may be noted the provision of an improved shoulder pad allowing freedom of movement of the upper body and particularly the shoulders so that the arms may be moved above a horizontal position without undue interference from the shoulder pad; the provision of such a shoulder pad which is durable and constructed effectively to absorb blows and to protect the wearer from injury; the provision of such a shoulder pad which is compact and simple in design; and the provision of such a shoulder pad which is economical to manufacture and easy to maintain.

Briefly, a shoulder pad of this invention comprises a left-hand member adapted to fit over the left shoulder and a right-hand member adapted to fit over the right shoulder, each of these members being a relatively rigid member of generally inverted U-shape as viewed from the side and having a chest plate portion, a back plate portion and an arch integrally connecting the plate portions. The arches are laterally spaced to provide an opening for the neck of the wearer with the spacing such that the arches lie adjacent and relatively close to the neck. The arches are relatively narrow in relation to the width of the shoulders so as to provide freedom for raising the arms above the horizontal position by allowing for upper movement of the outer part of the shoulders without substantial interference from the arches. Each of said members has padding on the inside thereof with the padding at the top of the arch of each member generally of the same narrow width as the arch so as to provide the aforementioned freedom. A pair of caps of relatively rigid material are adapted to fit over the outer part of the shoulders and are flexibly connected to respective arches. These caps have shoulder padding on the inside thereof separate from the arch padding for enabling the caps and the cap padding to move freely upwardly on upper movement of the outer part of the shoulders.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
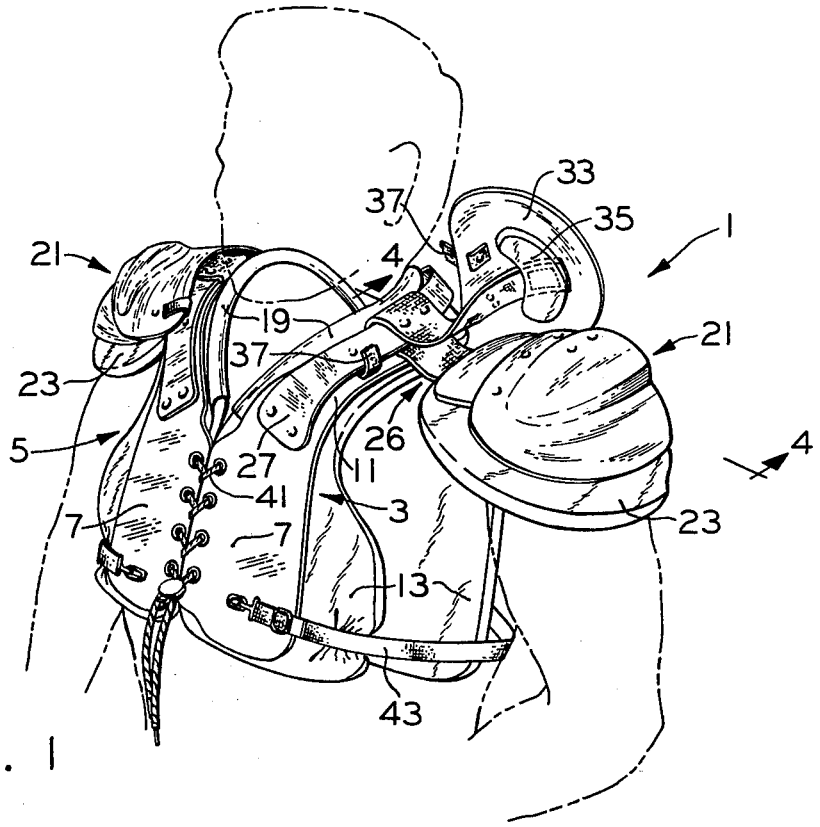
FIG. 1 is a perspective of the shoulder pad of this invention being worn by a football player, a flap of the shoulder pad being raised better to illustrate certain details of the invention.
Figure 4:
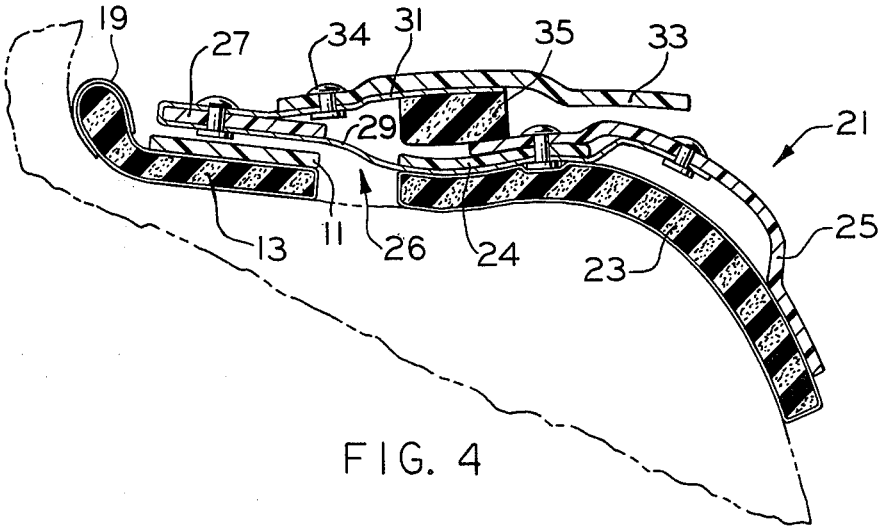
FIG. 4 is an enlarged section on line 4—4 of FIG. 1.

Referring to the drawings, a shoulder pad made according to the present invention is designated generally by the reference numeral 1 and is shown in FIG. 1 worn by a football player. It comprises a left-hand member generally indicated at 3 which fits over the left shoulder of the player and a right-hand member generally indicated at 5 which fits over the right shoulder. These two members 3, 5 may be of a suitable relatively lightweight plastic material, such as a high density polyethylene having a sufficiently high impact resistance to withstand the heavy blows received during the course of a football game. Each of the members 3, 5 is of generally inverted U-shape as viewed from the side and consists of a chestplate portion 7, a backplate portion 9 and an arch 11 integrally connecting the plate portions. The arches 11 of the two members 3, 5 are laterally spaced to provide an opening for the neck of the wearer with the spacing such that the arches lie adjacent and relatively close to the neck. As best illustrated in FIG. 4, each arch 11 is relatively narrow in relation to the width of the shoulder (preferably no more than 1½" wide), and is adapted to rest loosely on the shoulder in the narrow space between the neck and the upraised outer portion of the shoulder when the arm is raised over the head. Thus, freedom is provided for raising the arms above a horizontal position (as when a pass is thrown or a football received over the head) by allowing for upward movement of the outer part of the shoulders without undue interference from the arches.

For added protection, each of the members 3, 5 has padding indicated at 13 secured to the inside thereof as by stitching, which padding 13 preferably comprises a suitable closed-cell elastomeric vinyl foam in a stretch knit fabric cover. In accordance with this invention, the padding 13 at the top of the arch 11 of each member 3, 5 is generally of the same narrow width as the arch (as distinguished from conventional shoulder pads in which the padding typically extends laterally outwardly beyond the arch) so as to provide the aforementioned freedom of shoulder movement without substantial interference from the padding 13. Welted neck padding 19 is provided along the edges of the padding 13 adjacent the neck so as to assure that the neck is adequately guarded.

The shoulder pad 1 of this invention further includes a pair of caps, each generally designated 21, which overlie the outer portions of the shoulders for protecting those rather injury-prone areas of the body. As shown in FIGS. 1 and 4, each cap is flexibly connected to a respective arch. The caps have padding 23 stitched to the inside thereof and, in accordance with this invention, this cap padding is completely separate from the padding 13 at the top of the arch 11, thus enabling the caps 21 and the padding 23 thereon to move freely upwardly without restricting upward movement of the outer part of the shoulders. This is advantageous in that it further increases the mobility of the arms and shoulders. Cap padding 23 is of the same construction as padding 13.

Figure 2:
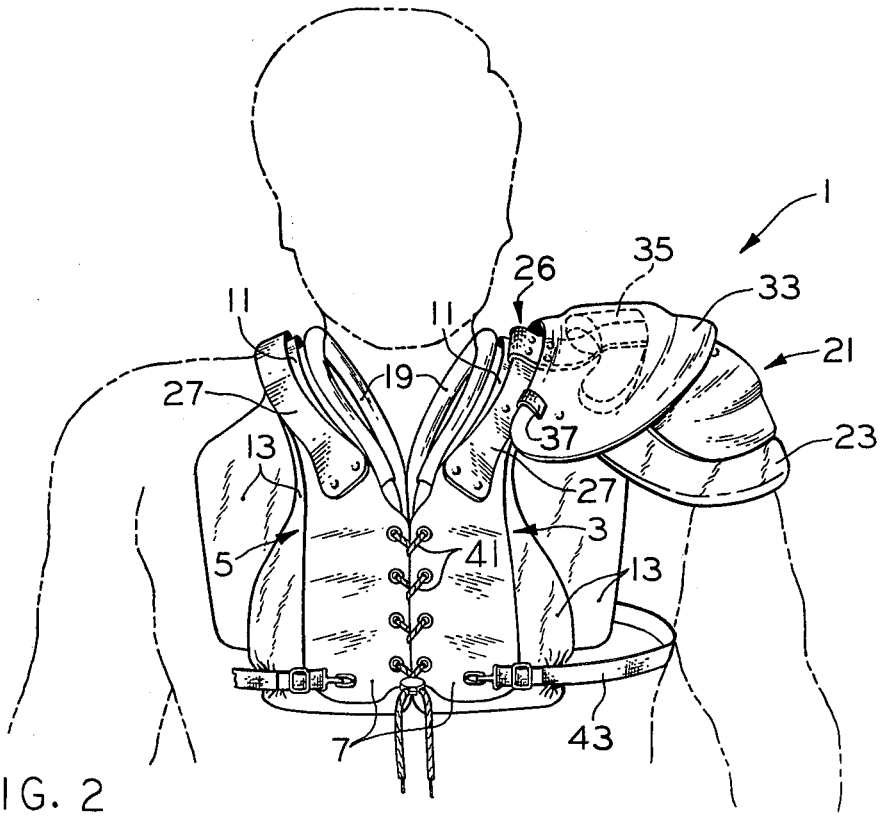
FIG. 2 is a front elevation of FIG. 1 with the flap and cap on one side of the shoulder pad removed to show the relatively thin arch and an arch stiffener.
Figure 3:
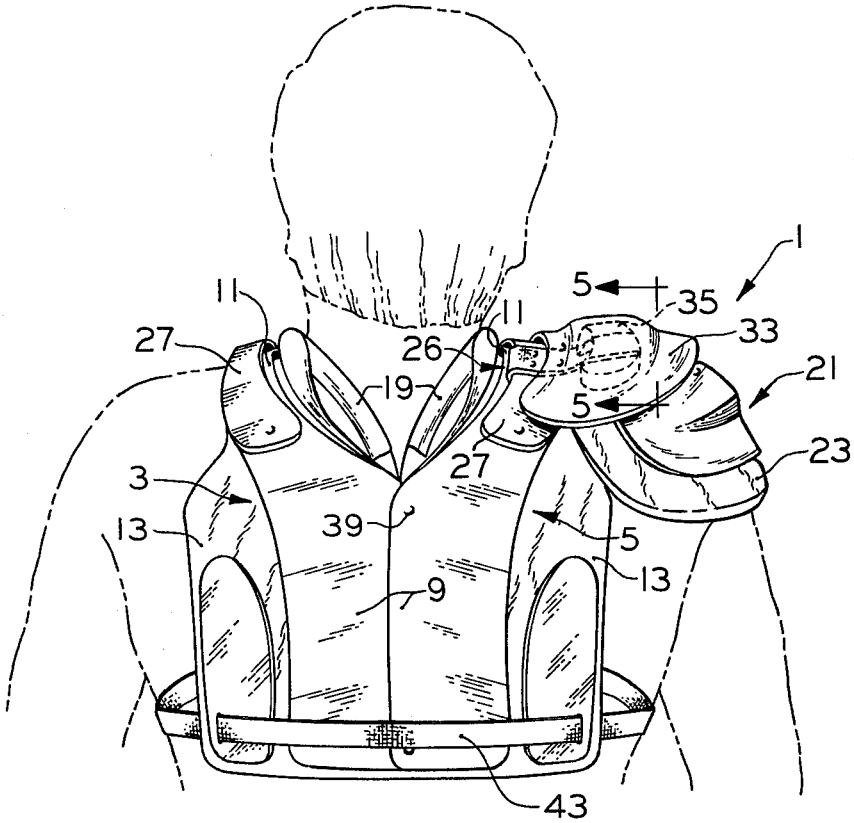
FIG. 3 is a rear elevation of FIG. 1 having portions removed as in FIG. 2.
Figure 5:
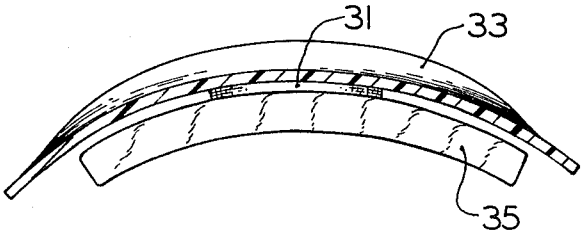
FIG. 5 is an enlarged section on line 5—5 of FIG. 3 illustrating a flap and a flap cushion.

More particularly, each cap 21 comprises an inner, relatively flat section 24 generally adjacent the arch 11 and an outer section 25 of inverted bowl-shape for fitting over the outer part of the shoulder. The cap 21 is connected to a respective arch by means of a flexible web 26 wrapped around and secured (as by rivets) to a stiffener 27 extending along the outside of the arch 11 at the top of the arch, the stiffener generally corresponding in width to that of the arch and being riveted to the arch at its ends. As wrapped around stiffener 27, the web 26 has a lower portion 29 extending laterally outwardly along the shoulder carrying the cap 21, which may be riveted or otherwise secured to the web in any suitable manner. Web 26 has an upper portion 31 extending laterally outwardly along the shoulder carrying a flap 33 of relatively rigid material which fits over the cap 21. The flap 33 is joined, as by rivets or other suitable permanent fasteners 34, to the web portion 31 laterally inwardly of the outer end of the web portion, the latter extending freely beneath the flap 33 and having a cushion 35 of resilient material stitched thereto. This cushion rests freely on the cap 21 under the flap 33 and softens and distributes the impact force resulting from a blow on the flap as that force is transmitted from the flap to the cap. In this regard, FIG. 5 indicates the cushion 35 as being formed so that its sections forward and rearward of the upper portion 31 of the web 26 are spaced from the underside of the flap more effectively to absorb blows on the flap. A snubber strap 37 (see FIGS. 1 and 2) hingedly connects the flap 33 and the stiffener 27 at the front of the flap for preventing rearward movement of the flap 33 upon a blow on the flap in the rearward direction.

The backplate portions 9 of the shoulder pad 1 are rigidly joined together by rivets or other suitable fasteners 39 while the chestplate portions 11 are adjustably laced together as indicated at 41. Adjustable elastic body straps 43 interconnect the backplate and chestplate portions 9, 7 and are worn under the arms of the wearer to prevent displacement of the shoulder pad upwardly and for otherwise keeping the shoulder pad in proper position on the athlete.

It will be observed from the above, that the improved shoulder pad of this invention allows freedom of movement of the upper body and particularly of the shoulders so that the arms may be moved above a horizontal position without substantial interference from the shoulder pad. Moreover, the shoulder pad 1 is constructed effectively to absorb blows and to protect the wearer from injury. Another advantage of the pad is that it is compact yet durable and simple in design for economical manufacture and maintenance.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A shoulder pad for football players comprising a left-hand member adapted to fit over the left shoulder and a right-hand member adapted to fit over the right shoulder, each of said members being a relatively rigid member of generally inverted U-shape as viewed from the side and having a chestplate portion, a backplate portion and an arch integrally connecting said plate portions, said arches being laterally spaced to provide an opening for the neck of the wearer with the spacing such that said arches lie relatively closely adjacent the neck, and said arches being relatively narrow in relation to the width of the shoulders and terminating laterally inwardly of the upraised outer portions of the shoulders when the arms are raised above the head for resting on the shoulders within the spaces between the neck and said upraised outer portions of the shoulders so as to provide freedom for raising the arms above a horizontal position by allowing for upward movement of the outer part of the shoulders without interference from said arches, each of said members having padding on the inside thereof with the padding at the top of the arch of each member generally of the same narrow width as the arch so as to provide said freedom, and a pair of caps of relatively rigid material adapted to fit over the outer part of the shoulders, said caps being flexibly connected to the arches and having shoulder padding on the inside thereof separate from said arch padding so as to enable the caps and padding thereon to move freely upwardly upon said movement of the outer part of the shoulders.

2. A shoulder pad as set forth in claim 1 wherein each of said arches has a stiffener extending along the arch at the top of the arch and each of said caps is connected to a respective arch by a flexible web wrapped around the stiffener and fastened to the stiffener with a lower portion of the web extending laterally outwardly along the shoulder and carrying said cap and an upper portion of the web extending laterally outwardly along the shoulder and carrying a flap of relatively rigid material adapted to rest on said cap.

3. A shoulder pad as set forth in claim 2 wherein said stiffener is on the outside of said arch and has a width generally corresponding to that of the arch.

4. A shoulder pad as set forth in claim 2 wherein said flap is secured to said upper web portion laterally inwardly of the outer end of the web portion with said outer end of said upper web portion extending freely beneath the flap and having a cushion secured thereto.

5. A shoulder pad as set forth in claim 4 wherein portions of said flap cushion are spaced from said flap.

* * * * *